US006093449A

United States Patent [19]

Carter, Jr. et al.

[11] Patent Number: 6,093,449

[45] Date of Patent: Jul. 25, 2000

[54] ATOMIZER FOR SPRAY FORMING RING STRUCTURES

[75] Inventors: William Thomas Carter, Jr., Galway; Mark Gilbert Benz, Burnt Hills; Robert John Zabala, Schenectady; Bruce Alan Knudsen, Amsterdam, all of N.Y.

[73] Assignee: General Electric Company, Schenectady, N.Y.

[21] Appl. No.: 08/854,369

[22] Filed: May 12, 1997

[51] Int. Cl.[7] ..... B05D 7/22; B05D 1/02; B05B 7/00; B22F 9/08

[52] U.S. Cl. ..... 427/233; 427/231; 427/236; 427/422; 427/425; 118/306; 118/317; 118/318; 75/338; 75/339

[58] Field of Search ..... 427/455, 231, 427/233, 236, 421, 422, 425; 118/306, 317, 318; 75/338, 339; 239/296, 8

[56] References Cited

U.S. PATENT DOCUMENTS

| | | | |
|---|---|---|---|
| 2,110,755 | 3/1938 | Bleakley | 427/233 |
| 4,066,117 | 1/1978 | Clark et al. | 164/46 |
| 4,687,825 | 8/1987 | Sagou et al. | 427/54.1 |
| 5,077,090 | 12/1991 | Sawyer | 427/241 |
| 5,160,532 | 11/1992 | Benz et al. | 75/10.24 |
| 5,366,206 | 11/1994 | Sawyer et al. | 266/202 |
| 5,472,177 | 12/1995 | Benz et al. | 266/202 |
| 5,480,097 | 1/1996 | Carter, Jr. et al. | 239/296 |

*Primary Examiner*—Shrive Beck
*Assistant Examiner*—Michael Barr
*Attorney, Agent, or Firm*—Ernest G. Cusick; Noreen C. Johnson

[57] ABSTRACT

A method and spray forming system for effectively spraying the inner diameters of intricate objects and makes inner diameter spray forming practical for articles that have various and complicated inner geometries. The spray forming system can include at least one of a rotating mandrel and preform, and atomizer, which is fed with liquid metal, to form a spray. The atomizer is positioned with respect to inner walls of at least one of the rotating mandrel and preform to accurately and fully spray form an inner diameter of an article, even if the article has complicated and irregular inner surfaces.

24 Claims, 3 Drawing Sheets

ATOMIZER FOR SPRAY FORMING RING STRUCTURES

BACKGROUND OF THE INVENTION

1. Field of the Invention

The invention relates to spray forming technology. In particular, the invention relates to a spray forming device and process to form ring geometries using inner diameter (ID) spraying.

2. Description of Related Art

A clean melting system for use in spray forming is disclosed in U.S. Pat. No. 5,160,532, the entire contents of which are incorporated by reference. The system disclosed in U.S. Pat. No. 5,160,532 uses a combination of an electroslag remelt furnace (ESR) and a cold induction guide (CIG).

Ring type structures have been previously made using several diverse methods. These methods include centrifugal casting, centrifugal atomization and spray forming. However, these methods have limitations regarding the number of different geometries and structures that can be accurately and properly formed.

Centrifugal casting generally involves the introduction of liquid metal into a rotating cylindrical mold. The rotation of the mold is at a speed to permit centrifugal acceleration to force the introduced liquid metal to outer diameter portions of the mold. The liquid metal can then solidify at those outer diameter portions of the mold. However, centrifugal casting is not suitable for use with articles that have at least one of intricate and complicated geometries, as for example, a tapered ring or a ring with varying cross-sectional area. Further, centrifugal casting is limited in use due to solidification rates of the associated liquid metal alloys, which would reduce the applicability of this method.

Centrifugal atomization involves generating an atomized liquid metal stream. A liquid metal stream is caused to be directed or fall on a rapidly rotating surface. The rotating surface atomizes the liquid metal stream. This also causes the atomized liquid metal stream to fall or be directed in a generally radially outward direction with a radially outward velocity. The generated atomized liquid metal stream cools somewhat over its movement. It is then collected on an inner diameter of a collector to form an article. However, centrifugal atomization is not suitable for spray forming articles that have various and complicated inner geometries.

A spray forming process uses gas atomization to form a spray of liquid metal droplets. The spray forming process directs the liquid metal spray onto a solid body. This solidifies the liquid metal spray to form a billet or billet preform. Spray forming has been used to manufacture cylindrical shapes, which can be either solid or hollow. Ring shapes and geometries have been sprayed successfully using an outer diameter (OD) spray forming. However, this type of spray forming process is not adequate for inner diameter (ID) spraying because of the complexities and difficulties in placing spray forming components inside an article to be formed, so as to spray form an inner diameter of an article.

Further, various problems have been associated with OD spraying, where these problems have prevented an acceptable end product from being formed. Problems, such as but not limited to, an increased porosity at the ID and a low yield, have prevented OD spraying from achieving an acceptable and desirable end product.

SUMMARY OF THE INVENTION

Therefore, it is an aspect of the invention to overcome the above-noted and other problems associated with spray forming and both centrifugal casting and atomization for inner diameter spraying.

It is another aspect of the invention to form articles that have intricate and/or complicated inner geometries by spray forming, in particular by an inner diameter spray forming process. It is another aspect of the invention to coat articles that have intricate and/or complicated inner geometries by spray forming, in particular by an inner diameter spray forming process.

It is a further aspect of the invention to provide a configuration of a spray forming device or system that makes inner diameter spray forming practical and that can spray form articles that have intricate and/or complicated inner geometries. For example, the device can include a rotating mandrel and atomizer positioned with respect to the rotating mandrel so as to accurately and fully spray form an inner diameter of an article, even if the article has complicated and irregular inner surfaces.

It is also another aspect of this invention to disclose components for inner diameter spraying device or system, in particular a stream shield, a chamber, a source and an atomizer, which can be effectively used in a spray forming process and system, in particular for spray forming an inner diameter of an article.

These and other aspects, advantages and salient features of the invention will become apparent from the following detailed description, which, when taken in conjunction with the annexed drawings, discloses preferred embodiments of the invention.

BRIEF DESCRIPTION OF THE DRAWINGS

While the novel features of this invention are set forth in the following description, the invention will now be described from the following detailed description of the invention taken in conjunction with the drawings, in which.

DETAILED DESCRIPTION OF THE EMBODIMENTS

Figure 1:
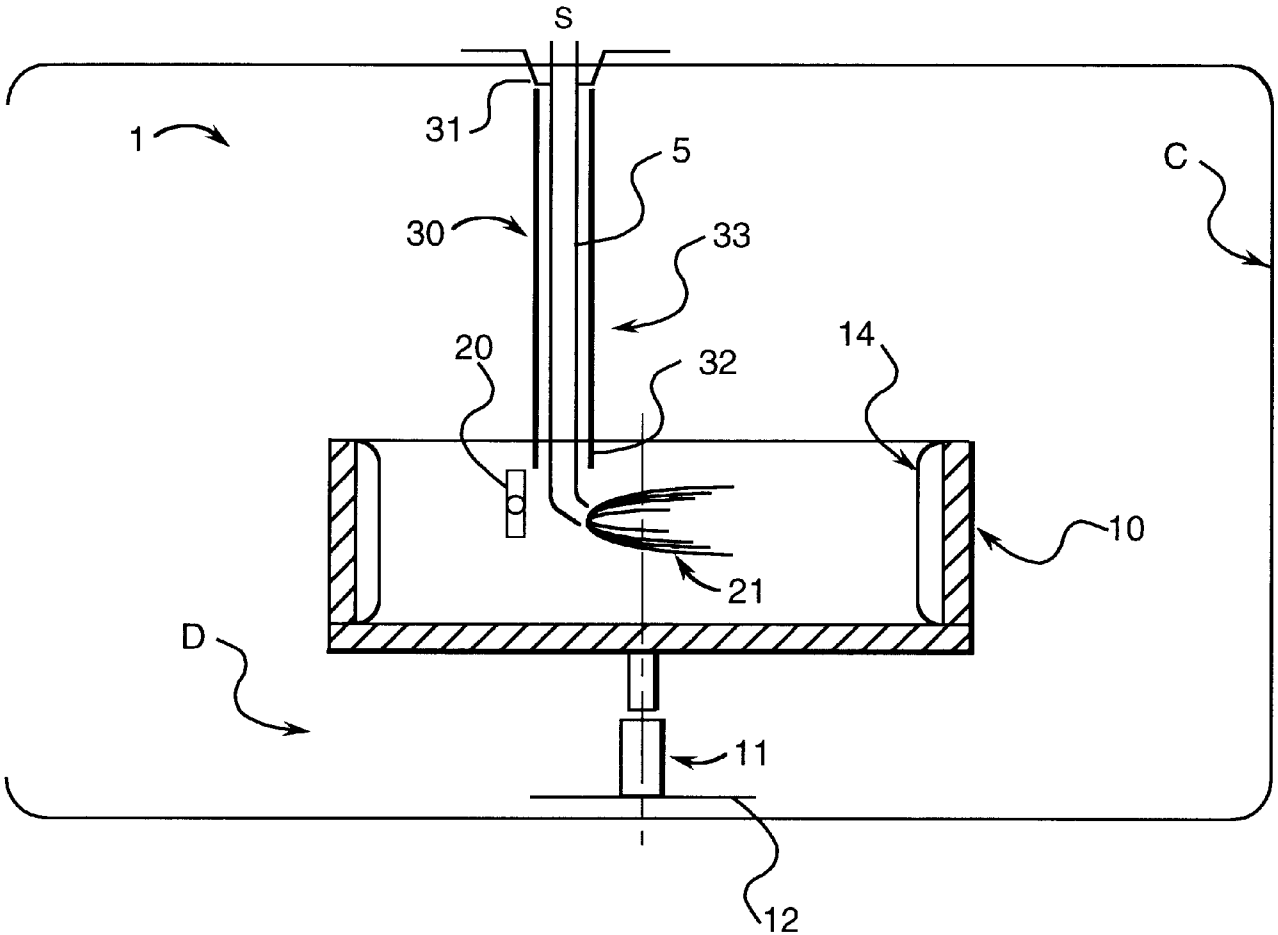
FIG. 1 is a side sectional view of a ring spraying system according to a first preferred embodiment of the invention.

FIG. 1 illustrates a first preferred embodiment of a spray forming spray forming spray forming system 1, as embodied in the invention. In FIG. 1, the spray forming device comprises a spray forming chamber C. The spray forming chamber C encloses the components needed for effectively spray forming inner diameters of objects. The spray forming chamber C provides a generally protective environment for the spray forming system 1. Further, the spray forming chamber C protects the resultant spray formed product, which may be susceptible to detrimental effects of an ambient environment that may cause oxidation or other adverse effects, from detrimental effects of an air environment.

The spray forming system 1 comprises a mandrel 10. The mandrel 10 is rotated by a drive system D, which can comprise a motive device, for example a motor 11 or other similar device. The motor 11 can be supported on an actuator, such as a linear actuator or transitional drive mechanism 12. A preform 14 may be mounted on the mandrel 10 to rotate with the mandrel 10. Alternatively, preform 14 may be mounted without the mandrel 10 to rotate by itself. Thus, at least one of the mandrel 10 and preform 14 is rotated about its central axis 13.

The rotation of at least one of the mandrel 10 and preform 14 accomplishes at least one of the many advantages of the invention. The rotation presents all faces of at least one of the mandrel 10 and preform 14, especially inner faces of the mandrel 10 and preform 14 to an impinging atomized metal stream 21 (to be described hereinafter). The rotation of at least one of the mandrel 10 and preform 14 also imparts a centrifugal force on sprayed material to assist in removing or driving out unwanted gas bubbles from the sprayed material. These gas bubbles would otherwise cause an undesirable porosity in the resulting metal product.

The rotation of the mandrel 10 also imparts a centrifugal force on the spray formed material. The centrifugal force on the spray formed material assists in the containment of the spray formed material on the mandrel as it cools. This assures that the spray formed material will form the intended end product.

Figure 2:
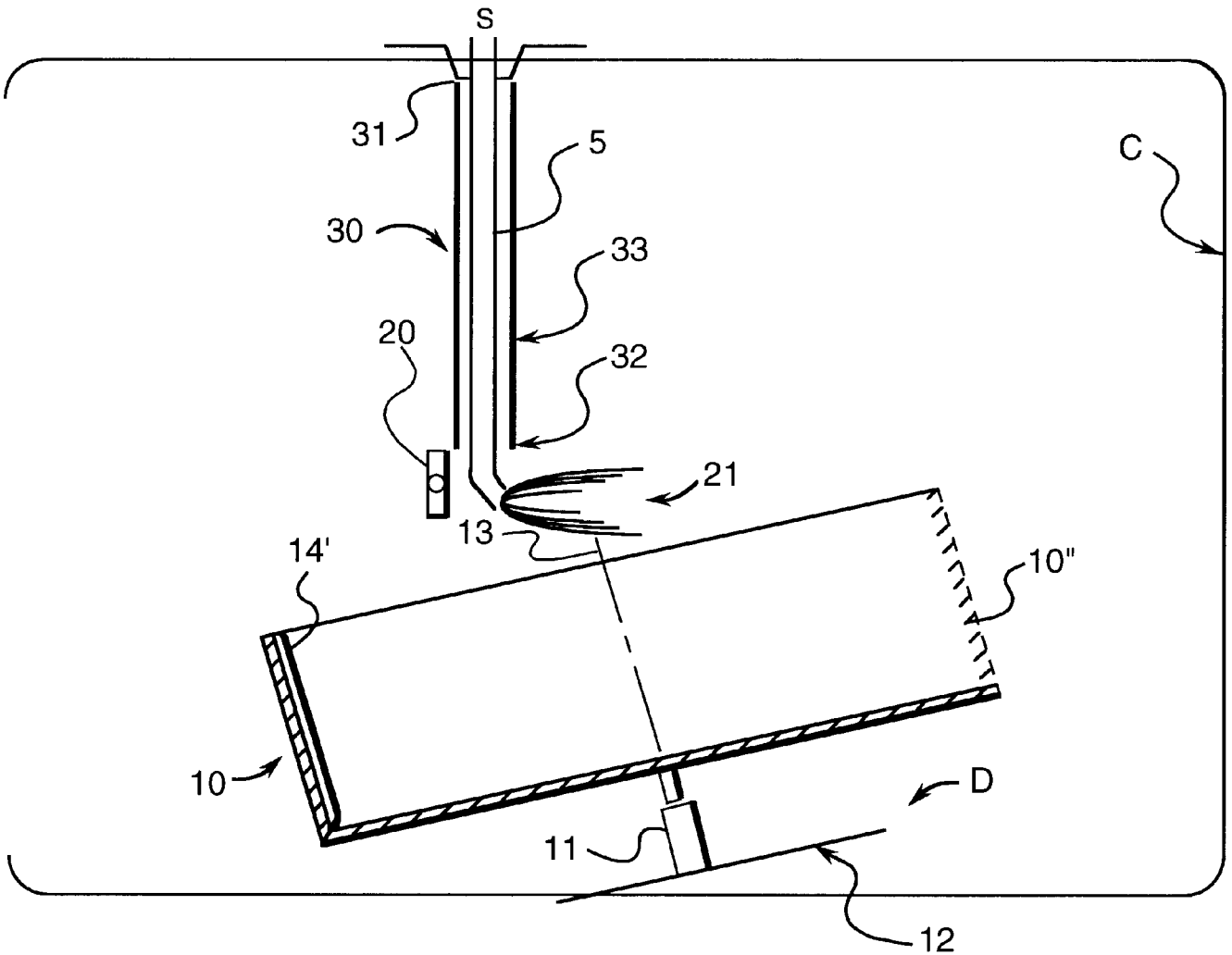
FIG. 2 is a side sectional view of a ring spraying system according to a second preferred embodiment of the invention.

At least one of the mandrel 10 and preform 14 may be vertically oriented or positioned so its vertical axis 13 is oriented with the vertical (FIG. 1) or at an angle relative to vertical axis (FIG. 2). This permits varied angles of spray access to the inner surfaces of one of the mandrel 10 and preform 14, and ensures complete coverage during spraying of the inner surfaces.

In FIG. 2, the mandrel 10' is formed with outwardly diverging side walls 10". The side walls 10" are thus presented to the spray 21 at an angle that the entire inner portion of the side wall 10" is freely presented to the spray 21. Therefore, an effective spray forming process is achieved.

The motor 11 or other drive mechanism imparts a rotation to the mandrel 10. As in FIGS. 1 and 2, the motor 11 is positioned on a linear actuator or transitional drive mechanism 12. The linear actuator or transitional drive mechanism 12 is affixed to one of the mandrel 10 and preform 14 of the spray forming system 1. Thus, at least various inner faces of the mandrel 10 and preform 14 are clearly and unobstructively presented to the impinging spray 21 from the atomizer 20, and a full coverage of these surfaces is possible.

The spray forming system 1 also comprises a source S for providing a liquid metal stream 5 to the atomizer 20. The source S can take any appropriate form, such as a furnace or heater integral with or connected to a supply of metal. The source can maintain the liquid metal molten and can also melt more metal if needed. The source S melts the metal and provides a liquid metal stream 5 for the spray forming system 1. The type of source S for the liquid metal stream 5 can be any conventional type known in the art. These types of sources are merely exemplary and not meant to limit the invention in any way.

A delivery system 30 is placed in fluid communication with the source S for the liquid metal stream 5. The delivery system 30 feeds liquid metal in the form of the liquid metal stream 5 from the source S to the atomizer 20. The delivery system 30 comprises a connection 31 to the source S and a feed end 32, which feeds the liquid metal stream 5 to the atomizer 20.

The delivery system 30 also comprises a sleeve or shield 33, which forms a conduit for the delivery of the liquid metal stream 5 to the atomizer 20. The sleeve 33 can possibly be cooled (by any appropriate cooling device), thus protecting the liquid metal stream 5 from undesirable gas flows in the spray forming chamber C that might otherwise deflect or pre-atomize the falling liquid metal stream 5.

The sleeve 33 can possibly be in direct contact with the liquid metal stream 5 so as to form a guide tube rather than a protective sleeve. In such a construction, auxiliary heating may be provided to offset heat losses in the guide tube. Such auxiliary heating may be provided by, for example, induction, as disclosed in U.S. Pat. No. 5,160,532, the entire contents of which are incorporated by reference.

Figure 3:
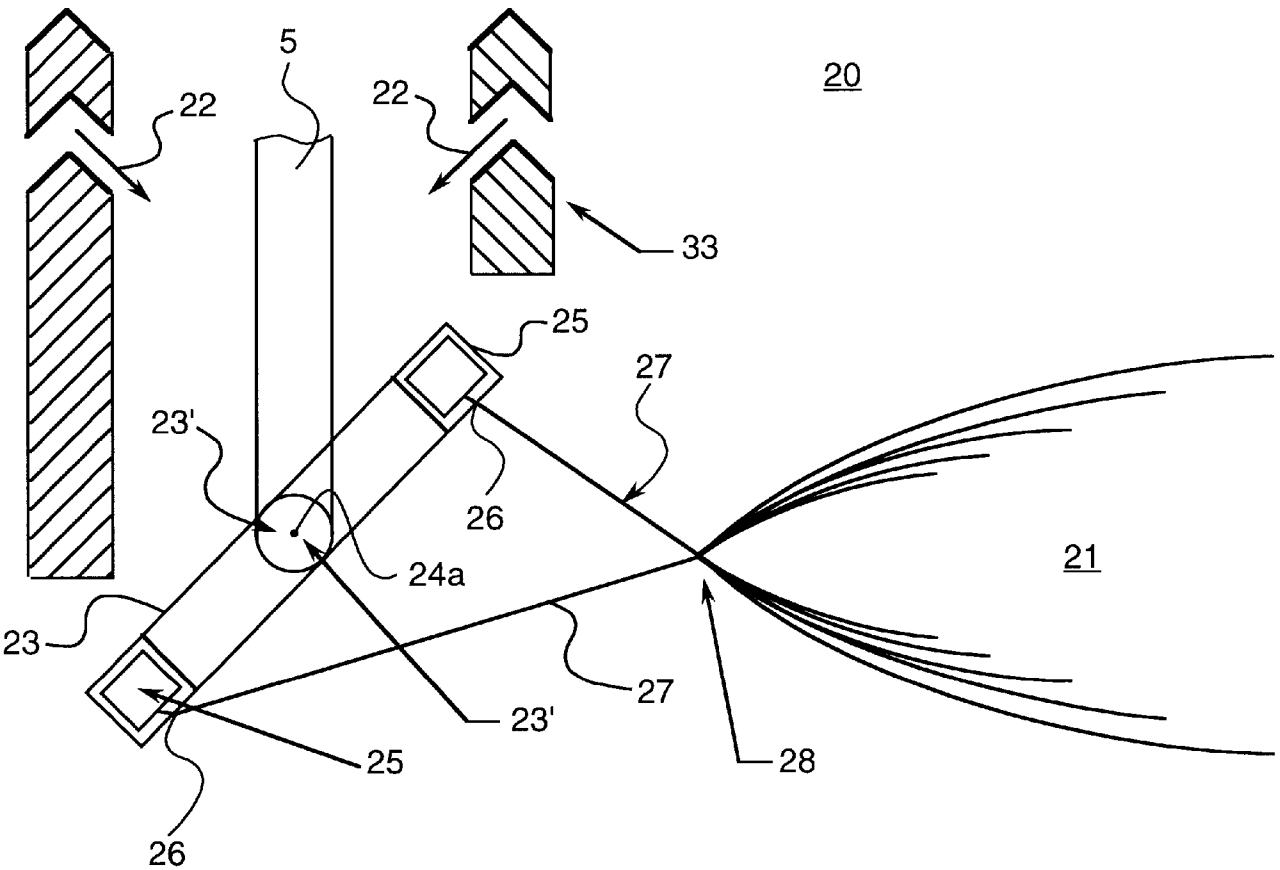
FIG. 3 is a partially sectional side perspective view of an atomizer in accordance with the invention.

The spray forming system 1 also includes an atomizer 20. The atomizer 20 is positioned, oriented or arranged to redirect the liquid metal stream 5 into a spray 21. FIG. 3 illustrates a close up of one perspective design of the atomizer 20, as embodied in the invention.

The atomizer 20 is shown in the figures as an articulated atomizer. However, this is merely exemplary and not meant to limit the invention in any way. For example, the atomizer may be configured to comprise some or all of the features set forth in U.S. Pat. No. 5,366,206 to Sawyer et al., U.S. Pat. No. 5,472,177 to Benz et al., and U.S. Pat. No. 5,480,097 to Carter et al., the entire contents of which are incorporated by reference.

The atomizer 20 comprises a pivoted member 23, supported by a support (not illustrated) so as to pivot about a pivot 23' on axis 24*a*. The pivoted member 23 is pivoted to direct the liquid metal stream 5 onto at least one of the inner diameter faces of the rotating mandrel 10 and the preform 14.

The pivoted member 23 comprises at least one, and preferably two or more, atomizing gas plenums 25. The plenums 25 may be separate chambers, a single chamber or inter-connected through at least one interconnection channel (not illustrated). The plenum 25 may have any appropriate geometry or shape and be positioned at any appropriate point along the pivoted member 23, so long as it forms a spray 21.

Each plenum 25 is fed a gas, which is under pressure, the pressure not need not to be great as long as it forms a spray, from an appropriate source (not illustrated) on the support for the pivoted member 23. The support for the pivoted member 23 includes conduits or similar passageways for the supply and delivery of atomizing gas to the plenums 25.

The gas from the plenum 25 exits through nozzles or holes 26 in each plenum 25. As seen in FIG. 3, the nozzles or holes 26 are oriented to cooperate with each other and direct the gas into a series of individual gas jets 27. These individual gas jets 27 converge at an atomization zone 28 to form the spray 21. Thus, the liquid metal stream 5 can be fed through the shield 33 from the source S, and be formed into a spray 21 by the atomizer 20.

The atomizer 20 is also fed gas through auxiliary control gas jets 22. These auxiliary control gas jets 22 are positioned on the shield 33 to feed an auxiliary supply of gas, which ensures that backflow of gas from the plenum 25 does not enter the shield 33.

As illustrated in FIG. 1, a centerline of the atomizer need not be coincident with the axis centerline of the mandrel 10. Further, the respective axes need not be aligned, as shown in FIG. 2, but can be presented in any of a number of orientations.

While the embodiments described herein are preferred, it will be appreciated from the specification that various combinations of elements, variations or improvements therein may be made by those skilled in the are that are within the scope of the invention.

What is claimed is:

1. A spray forming method, the method comprising:

rotating an article using a motor, the motor disposed proximate and directly connected to the article, the rotating an article presenting inner surfaces and side walls of the article oriented in a first direction;

providing a stream of liquid metal to an atomizer;

forming a spray of the liquid metal; and directing the spray of liquid metal in a second direction that is generally perpendicular to the first direction onto inner surfaces and side walls of the rotating article when the inner surfaces and side walls are oriented in the first direction so the spray impacts the side walls at substantially right angles, wherein the rotating an article comprises rotating an article at varied angles by moving the motor through varied angles with respect to the stream of liquid metal to present the inner surfaces and side walls of the article oriented in the first direction to the spray of liquid metal.

2. A method according to claim 1, wherein the rotating comprises rotating a preform.

3. A method according to claim 1, wherein the rotating an article comprises actuating a drive system for rotating an article.

4. A method according to claim 3, wherein the drive system rotates a mandrel for rotating an article.

5. A method according to claim 3, wherein the drive system rotates a mandrel, the rotating an article comprises rotating an article comprises the preform attached to the mandrel.

6. A method according to claim 1, further comprising enclosing the article, stream of liquid metal, atomizer, spray of liquid metal, so as to protect the article, stream of liquid metal, atomizer and spray of liquid metal from an ambient atmosphere.

7. A method according to claim 1, further comprising imparting a centrifugal force by rotating the article.

8. A method according to claim 1, further comprising shielding the stream of liquid metal by providing a shield.

9. A method according to claim 1, further comprising passing the stream of liquid metal through gas from at least one gas fed plenum.

10. A method according to claim 9, further comprising passing the stream of liquid metal through gas from at least one nozzle of the at least one gas fed plenum.

11. A method according to claim 1, further comprising forming an object by the directing the spray.

12. A spray forming system comprising:

a source of liquid metal;

an atomizer;

at least one of a rotatable mandrel and preform comprising inner surfaces and side walls;

a motor disposed proximate and directly connected to the at least one of the rotatable mandrel and preform, the motor capable of moving through varied angles with respect to the source of liquid metal so as to present inner surfaces and side walls oriented at a first direction; and a delivery system to provide the liquid metal from the source of liquid metal to the atomizer;

wherein the atomizer sprays the liquid metal in a second direction that is generally perpendicular to the first direction onto the inner surfaces of the at least one of a rotatable mandrel and preform where the spray impacts the side walls at substantially right angles when the side walls are oriented in the first direction, and the at least one of a rotating mandrel and preform is capable of rotating at varied angles to the delivery system by moving the motor through varied angles with respect to the source of liquid metal to present the inner surfaces and side walls oriented in the first direction to the spray of liquid metal.

13. A system according to claim 12, comprising a preform, the atomizer spraying the preform.

14. A system according to claim 12, comprising a mandrel, the atomizer spraying the liquid metal onto at least one surface of the mandrel.

15. A system according to claim 12, comprising a mandrel and a preform.

16. A system according to claim 12, further comprising a drive system, the drive system coupled to at least one of the rotatable mandrel and preform.

17. A system according to claim 12, the source comprising a heater to maintain the liquid metal in a liquid state.

18. A system according to claim 12, further comprising a delivery system, the delivery system comprising a shield.

19. A system according to claim 12, further comprising a delivery system, the delivery system comprising a guide tube.

20. A system according to claim 19, further comprising a heater to heat the guide tube.

21. A system according to claim 12, the atomizer comprising an articulated atomizer.

22. A system according to claim 21, the articulated atomizer comprising a pivoted atomizer component, pivoted atomizer component comprising at least one gas fed plenum, the at least one gas fed plenum comprising at least one nozzle that forms a spray of liquid metal.

23. A system according to claim 22, further comprising auxiliary control gas jets, the auxiliary control gas jets positioned to feed an auxiliary supply of gas to prevent a back flow of gas from the plenum.

24. A system according to claim 12, wherein an object is formed by the spraying of liquid metal.

* * * * *